United States Patent [19]

Castonguay et al.

[11] Patent Number: 4,499,344

[45] Date of Patent: Feb. 12, 1985

[54] INTERLOCK ARRANGEMENT FOR CIRCUIT BREAKER COMPARTMENTS

[75] Inventors: Roger N. Castonguay, Terryville; David B. Powell, Burlington, both of Conn.

[73] Assignee: General Electric Company, New York, N.Y.

[21] Appl. No.: 483,995

[22] Filed: Apr. 11, 1983

[51] Int. Cl.[3] ..... H01H 9/20

[52] U.S. Cl. ..... 200/50 C; 200/50 AA; 361/339

[58] Field of Search ..... 361/339, 50 AA, 50 C

[56] References Cited

U.S. PATENT DOCUMENTS 2,646,474 7/1953 Stratton ..... 200/50 C 4,317,160 2/1982 Tillson et al. ..... 200/50 AA

*Primary Examiner*—A. D. Pellinen

*Assistant Examiner*—Morris Ginsburg

*Attorney, Agent, or Firm*—R. A. Menelly; W. C. Bernkopf; Fred Jacob

[57] ABSTRACT

An interlock arrangement is provided between adjoining circuit breaker compartments by the addition of a contact arm operated interlock to circuit breakers which contain trip arm operated interlocks. The contact arm interlock comprises a paddle mounted on the rear surface of each of the adjoining breakers for sensing the condition of the contacts in one breaker and for interreacting with the trip arm interlock mechanism to trip the breaker when an attempt is made to close the first breaker contacts while the adjoining breaker contacts are closed. A stop lever mounted in the first breaker compartment interconnects with a similar lever mounted in the compartment of the adjoining breaker to prevent the first breaker contacts from being closed while the adjoining breaker contacts are closed. The compartment interlock arrangement finds utility when one of the interconnected circuit breakers connects with a utility power source and the other circuit breaker connects with an auxiliary generator.

14 Claims, 10 Drawing Figures

INTERLOCK ARRANGEMENT FOR CIRCUIT BREAKER COMPARTMENTS

BACKGROUND OF THE INVENTION

Circuit breaker compartments generally employ an interlock arrangement to prevent the circuit breaker plugs from being connected with or disconnected from the compartment power stabs when the breaker contacts are closed. U.S. Pat. No. 3,663,773 to David B. Powell, discloses an interlock mechanism that interferes with the contact push rod when the breaker contacts are closed for preventing withdrawal of the breaker. U.S. Pat. No. 4,317,160 to Robert S. Tillson et al. discloses an interlock mechanism which operates on the tripping plunger rod to prevent the circuit breaker from being removed from the compartment power stabs when the breaker contacts are closed. This Patent also discloses the interreaction between the contact push rod and a racking rod such that the racking rod prevents the insertion of a racking tool when the contacts are closed.

While the aforementioned U.S. Patents disclose circuit breaker compartment interlocks for preventing circuit breakers from being disconnected from the compartment power stabs when the breaker contacts are closed, U.S. Pat. No. 2,646,474 to Robert L. Stratton discloses an interlock arrangement between two adjoining circuit breaker compartments. The Stratton interlock interconnects the contact push rods of the circuit breakers within the adjoining compartments in such a manner that the circuit breaker contacts in one compartment can only remain closed while the circuit breaker contacts in the adjoining circuit breaker remain open.

The purpose of the instant invention is to provide a circuit breaker interlock arrangement that prevents the contacts of either one of two adjoining circuit breakers from being closed while the other breaker contacts are closed.

SUMMARY OF THE INVENTION

The circuit breaker compartment interlock arrangement of the invention utilizes a pair of paddles one mounted on the rear surface of each of a pair of adjoining circuit breakers in separate compartments and a corresponding pair of levers each mounted within the separate compartments and interconnected, for causing an interaction between the contact push rod and the tripping plunger rod in the first compartment to trip the breaker when an attempt is made to close the first breaker while the breaker in the second compartment is closed, and vice versa.

DESCRIPTION OF THE PREFERRED EMBODIMENT

Figure 1:
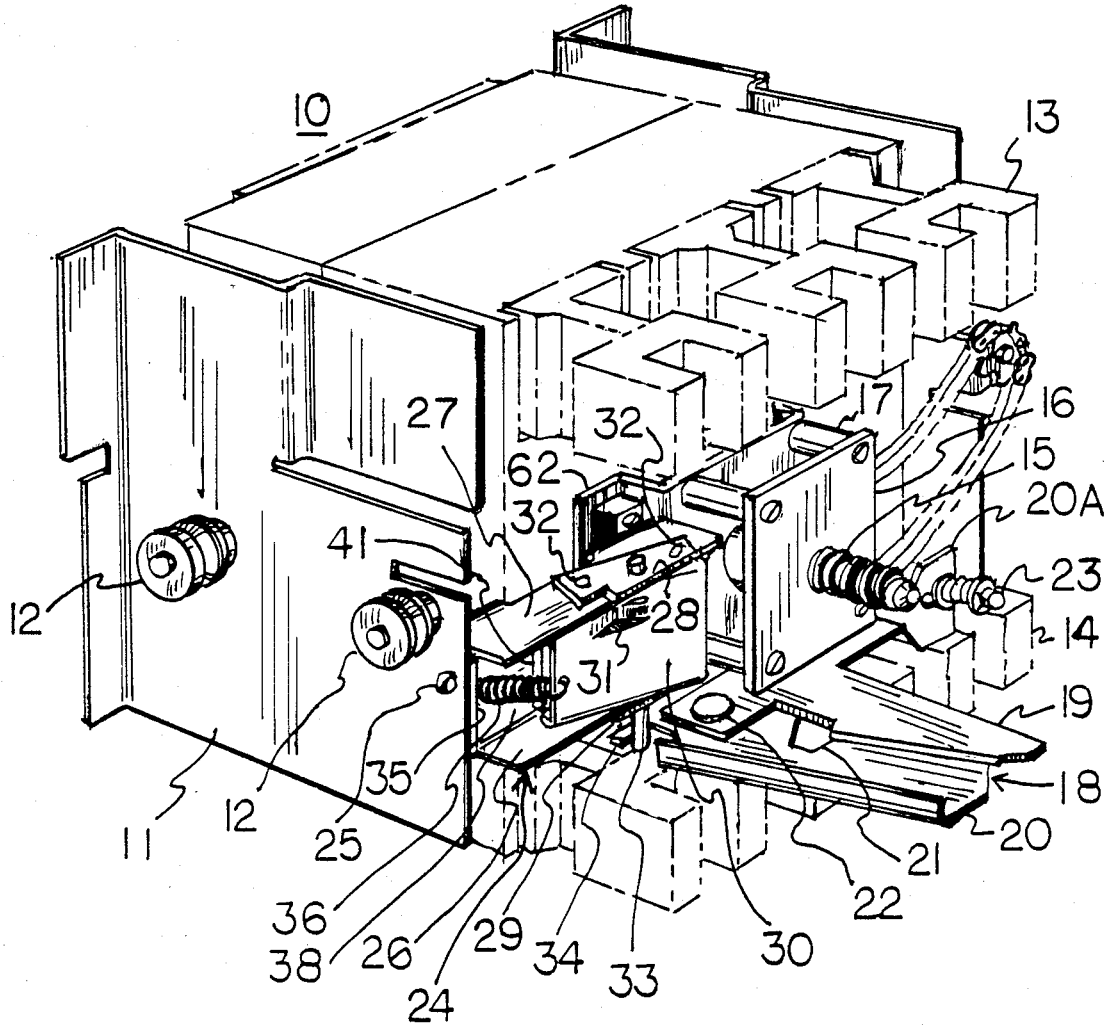
FIG. 1 is a front perspective view of the breaker mounted components of the interlock assembly of the invention attached to the rear of a compartmented circuit breaker.
Figure 2:
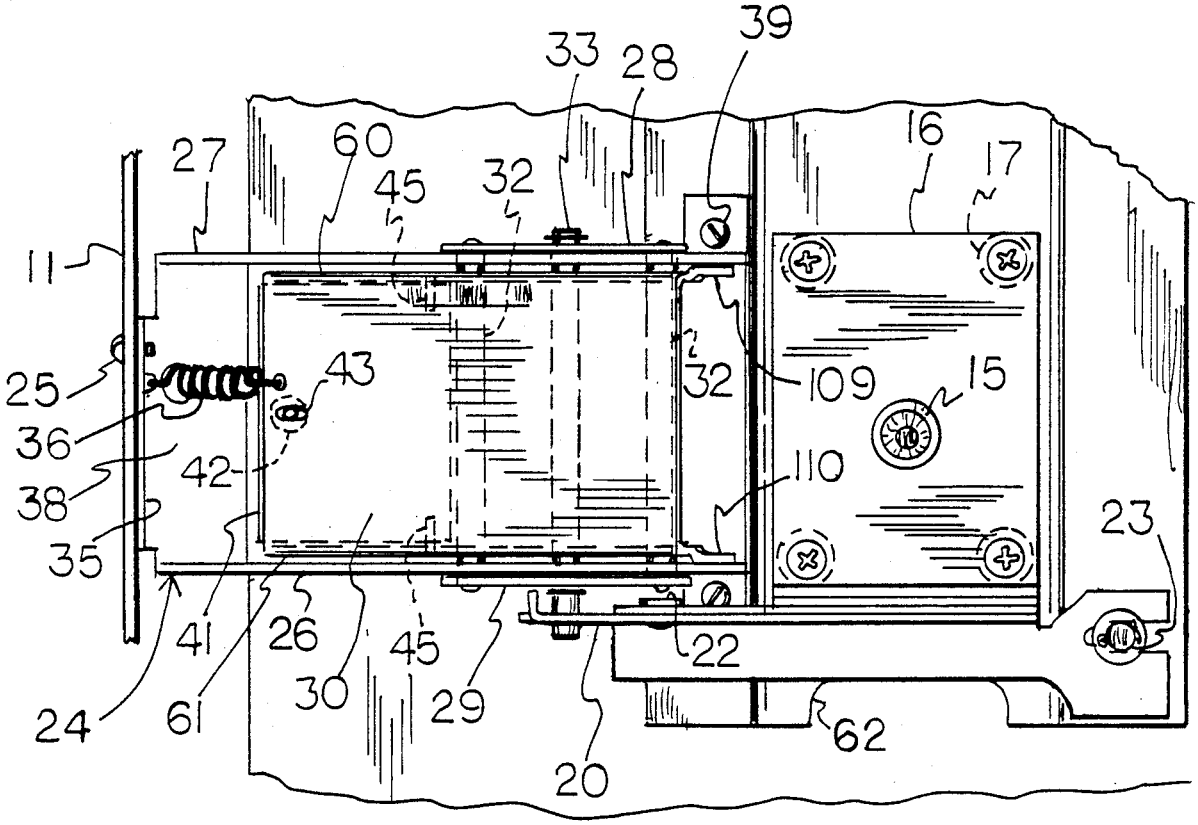
FIG. 2 is a front view of the assembly depicted in FIG. 1.

The circuit breaker interlock arrangement of the invention consists basically of two sets of components, one of which is mounted on the rear surface of the circuit breaker itself and is defined as the "Breaker Mounted Interlock Assembly", and the other of which, defined as the "Compartment Mounted Interlock Assembly", is mounted on the circuit breaker compartment rear wall. FIG. 1 contains a compartment mounted circuit breaker 10 having a sideplate 11 attached to the breaker and containing a pair of wheels 12 for moving the breaker in and out of the compartment. Three line plugs 13 are attached to the rear surface of the breaker along with three load plugs 14 for mating with corresponding line and load stabs on the compartment rear wall. Similar to the description within the patent to Tillson et al, the breaker plugs are connected with the compartment stabs by means of a racking screw 15 attached to the rear surface of the breaker by means of a journal plate 16, mounting posts 17 and a mounting pan 62. An interlock mechanism 18 consisting of a fixed finger 19 and a moveable finger 20 serve to trip the breaker via the moveable finger extension 20A and trip plunger 23 when an attempt is made to connect or disconnect the breaker plugs and the compartment stabs when the breaker contacts are closed. The breaker mounted interlock assembly 24 of the invention is attached to the breaker carriage sideplate by the insertion of screws 25 through the assembly sideplate 35. The back wall 38 of the assembly is also fastened to the back wall of the circuit breaker by means of screws. The bottom plate 26 supports a paddle 30 which includes a recess 31 for contacting with the compartment mounted interlock assembly and a spring 36 for biasing the panel toward the back wall 38. Paddle 30 is supported between bottom and top plates 26, 27 by means of a pair of link pins 32 and an actuator pin 33. The link pins are in turn captured by means of a pair of top and bottom links 28, 29. The bottom of actuator pin 33 abuts an extension tab 34 on moveable finger 20, which is pivotally connected with the fixed finger 19 by means of pivot 22 and which defines a notch 21 for purposes described within the patent to Tillson et al. The other end of moveable finger 20, denoted as 20*a*, is hooked to the trip plunger 23 causing the circuit breaker to trip via interlock mechanism 18. The breaker mounted interlock assembly 24 senses the condition of the breaker contacts via breaker contact plunger 130 shown in FIG. 8, for example, and via the end of actuator pin 33 and extension tab 34 force the moveable finger extension 20A to displace trip plunger 23 outward and trip the breaker. The breaker mounted interlock assembly 24 is shown in FIG. 2 mounted to the breaker carriage sideplate 11 by screw 25 and to the mounting pan 62 by screws 39. A pivot plate 41 located behind paddle 30 and pivotally connected between the bottom and top extensions 61, 60 by means of pivot pins 45 is interposed between the contact arm plunger and the paddle and adjustment is made by screw 42 which is accessed via slot 43 through paddle 30 to compensate for any variations in length between the various contact arm plungers. Since the purpose of the pivot plate 41 is to abut the contact arm plunger as well as the paddle 30, the zero clearance provided by adjusting screw 42 accessable through slot 43 allows the motion of the contact plunger to be immediately transmitted to the paddle. Top and bottom links 28, 29 which are supported by a pair of link pins 32 allows for two conditions of motion of paddle 30. The first condition is the relatively free motion of the paddle against the bias of return spring 36 with no motion imparted to actuator pin 33. The second condition occurs when the paddle forces the motion of one of the link pins 32 which in turn moves the actuator pin 33 into contact with the extension tab 34 (FIG. 3) to trip the breaker. A pair of top and bottom guides 109, 110 allow the paddle to move smoothly between the top and bottom plates in order to prevent any binding or cocking motion which could otherwise occur. The breaker mounted interlock assembly 24 is shown located relative to the moveable interlock finger 20 and interlock finger pivot 22 so that contact between the actuator pin 33 and the extension tab 34 is immediately transmitted to trip plunger 23. The back wall 38 of the breaker mounted interlock assembly is secured to the breaker by means of screws 39 in such a manner as not to interfere with the breaker racking screw 15 which is supported on journal plate 16 by means of posts 17 as described earlier.

Figure 3:
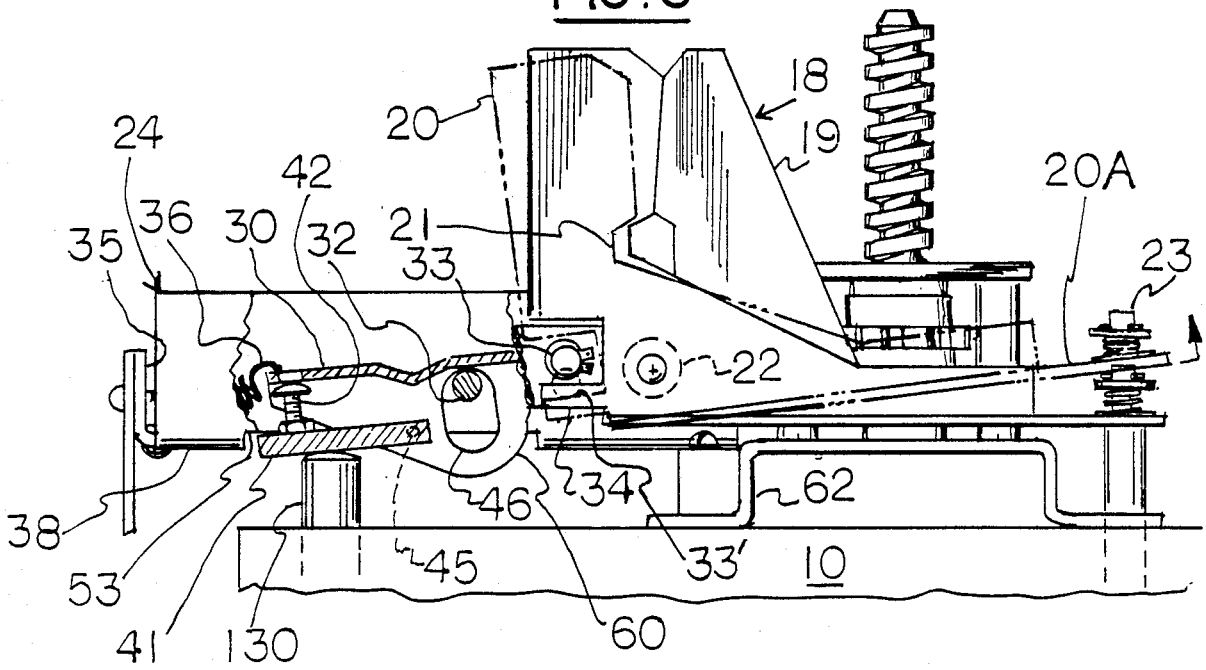
FIG. 3 is a bottom view of the assembly depicted in FIGS. 1 and 2.

The interlock arrangement 18 is shown in FIG. 3 with the fixed finger 19, moveable finger 20 and notch 21 operational in the event that an attempt is made to connect or disconnect the breaker plugs and compartment stabs when the breaker contacts are closed in the manner described within the patent to Tillson et al. The moveable finger 20, in the direction indicated and shown in phantom, is the trip position wherein the moveable finger extension 20A is indicated in phantom and the trip plunger is in its extended trip position, also shown in phantom. The breaker interlock mechanism 18 is free to operate independent from the breaker compartment interlock arrangement of this invention. The breaker mounted interlock assembly 24 is shown with the paddle 30 in the position taken when the contacts are open and the breaker contact arm plunger or push rod 130 is not fully extended. Link pin 32 is at the top end of slot 46 and actuator pin 33 is out of contact with the moveable finger extension tab 34.

Figure 4:
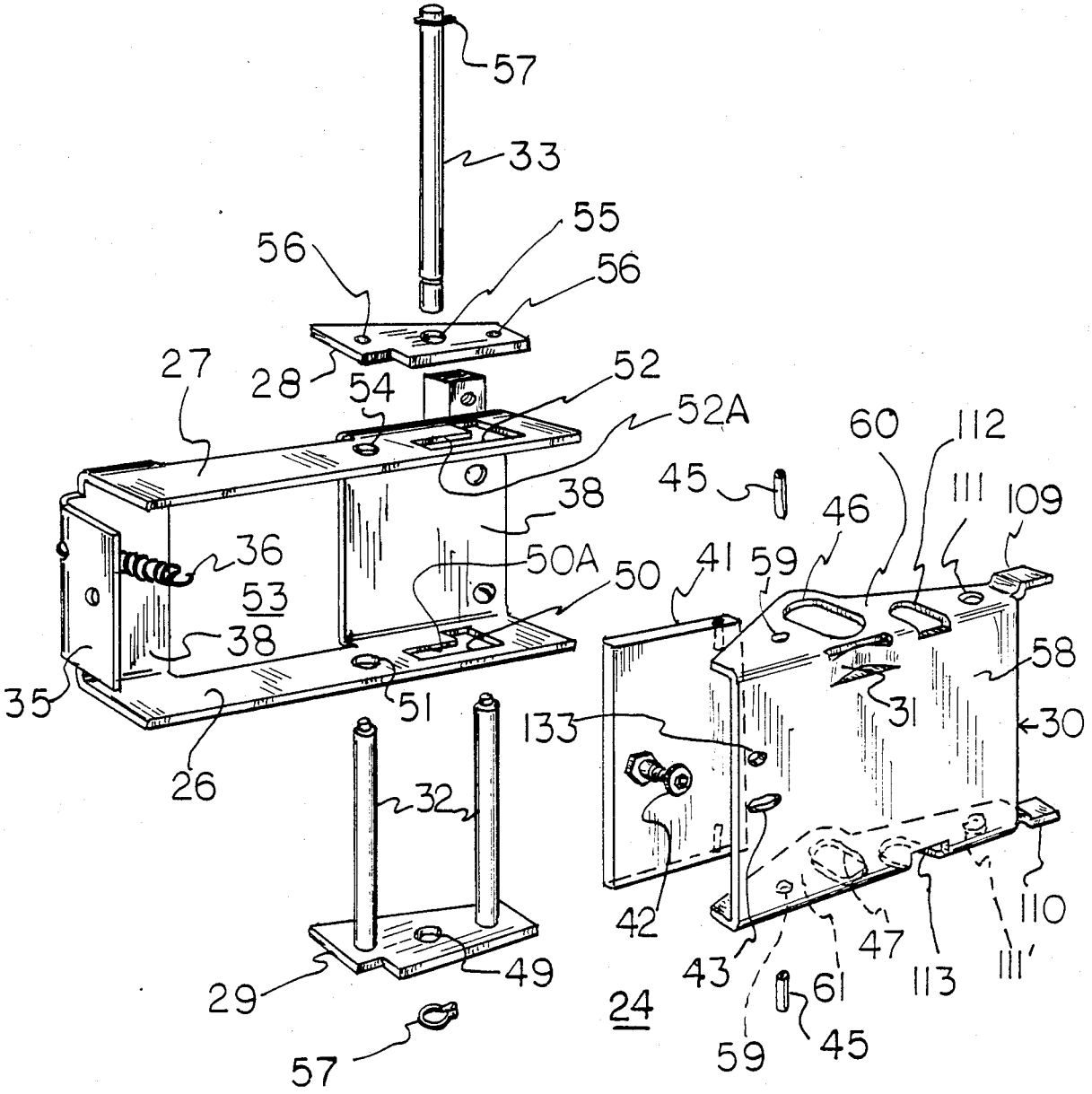
FIG. 4 is an exploded perspective view of the assembly depicted in FIGS. 1–3.

The relationship between the components of the breaker mounted interlock assembly 24 are shown in FIG. 4 wherein the paddle 30 is formed from a plate 58 having angled top and bottom extensions 60, 61. A slot 46 is formed in the top extension to provide for the travel of link pin 32 when inserted between slot 46 in top angled extension 60 and slot 47 in angled bottom extension 61. The actuator pin 33 and the other link pin 32 are both within slots 50, 52, also formed in the top and bottom plates 27, 26. Top and bottom guides 109, 110 are formed in the respective top and bottom extensions for the purpose described earlier and a recess 31 is formed on the front surface of plate 58 for receiving the compartment mounted interlock assembly which will be described below. In assembling the paddle 30 between bottom and top plates 26, 27, recess 31 faces forward and one end of return spring 36 is inserted within spring hole 133 and the other end of the spring is inserted within a corresponding hole within the angled side plate 35. The actuator pin 33 is inserted first through a hole 55 in top link 28, then through a top guide slot 52 formed within top plate 27 before insertion between the top and bottom slots 46, 47 in paddle 30. The bottom of actuator pin 33 is then inserted within guide slot 50 in bottom plate 26. Top guide 109 and bottom guide 110 slideably abut the inner surfaces of top plate 27 and bottom plate 26. The bottom link 29 containing link pins 32 and a clearance hole 49 for the actuator pin 33, is then inserted through a clearance hole 51 in bottom plate 26 and through the bottom guide slot 50 through corresponding clearance holes 111, 111' and slots 47, 46, through paddle 30 up through clearance hole 54 and slot 52 in top plate 27, before the top link 28 is positioned above top plate 27 and the link pin clearance holes 56 receive the top end of link pins 32 before riveting. Actuator pin 33 is then assembled within hole 55, slot 52, slots 112, 113, 50 and hole 49 in lower link 29 before applying spring clip 57. Back wall 38 contains an opening 53 to provide clearance for pivot plate 41. The pivot plate is attached between the top and bottom extensions 60, 61 by means of pivot pins 45 through holes 59 and the adjustment screw 42 faces toward the paddle 30.

Figure 5A:
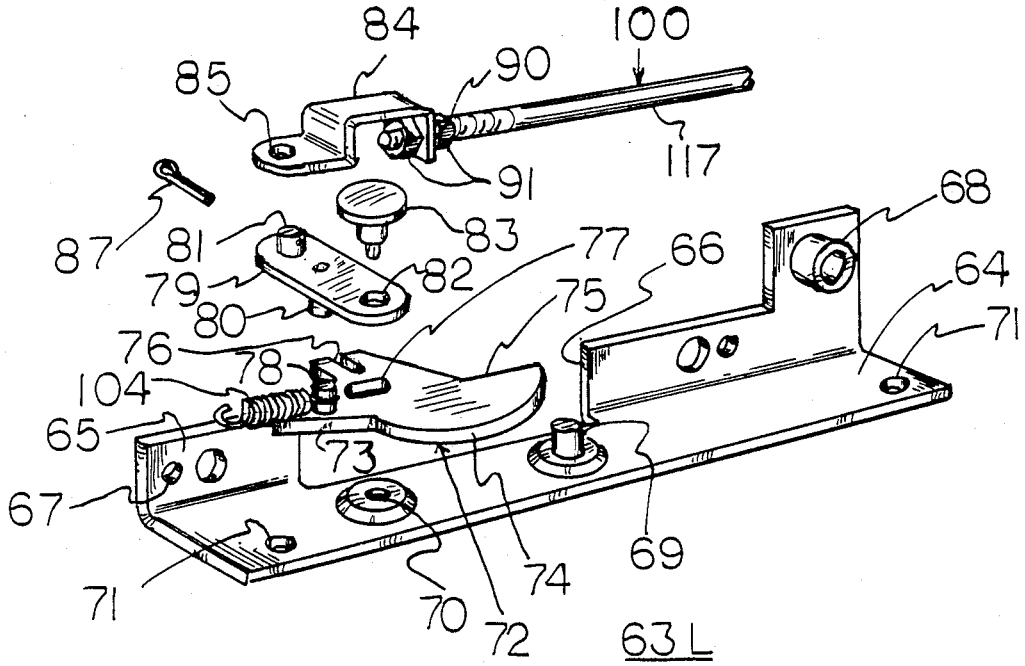
FIG. 5A is an exploded perspective view of the left side compartment mounted components of the interlock assembly of the invention.
Figure 5B:
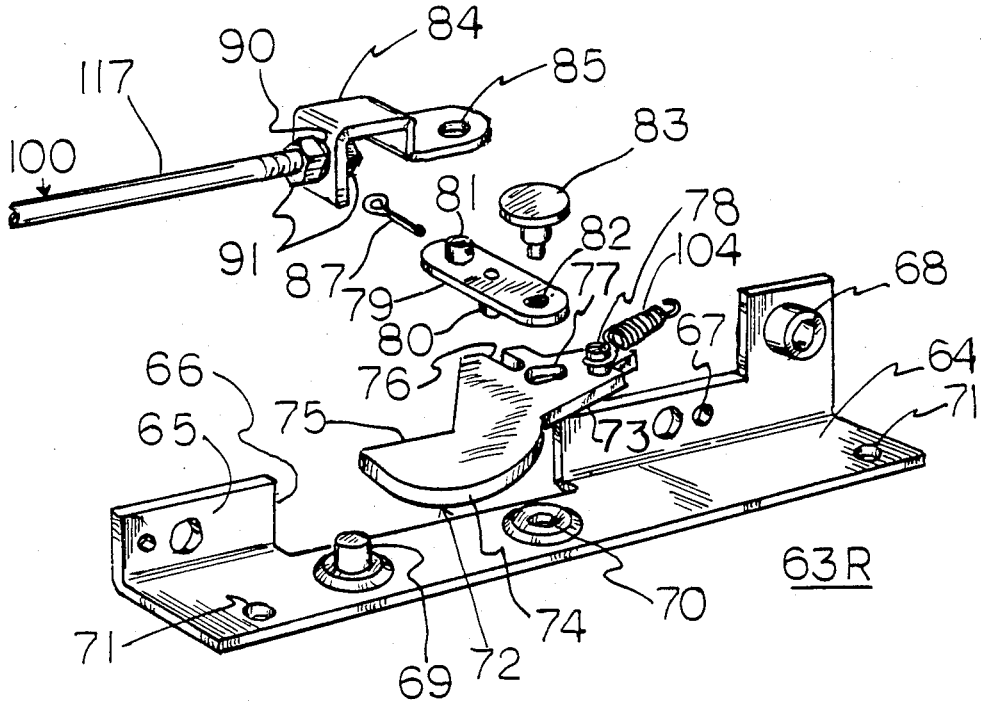
FIG. 5B is an exploded perspective view of the right side compartment mounted components of the interlock assembly of the invention.

The compartment mounted interlock assembly 63 is assembled in the following manner as shown in FIGS. 5A and 5B. A left side compartment mounted assembly 63L is shown in FIG. 5A and a right side assembly 63R is shown in FIG. 5B with common reference numbers used for similar elements. A base plate 64 having angled sidewall 65 is provided with clearance notch 66 and a journal 68 is provided on an upraised section of the sidewall for purposes to be described below. A stop post 69 is fastened to the base plate along with a pivot pin hole 70 and clearance hole 71 for allowing the base plate to be attached to the compartment racking nut channel. The stop lever 72, formed from one piece of metal, has a linear arm section 73 and a radial arm section 74. A stop surface 75 is formed opposite the radial arm and a guide slot 76, pivot pin slot 77 are both formed or machined within the linear arm. A post 78 is fastened proximate the pivot slot 77 for attaching a spring 104. The stop lever 72 is positioned on pivot hole 70 parallel with base plate 64 and a link lever 79 is connected to the stop lever by the insertion of pivot pin 83. Guide pin 80, attached to link lever 79, fits in slot 76 in stop lever 72 and post 81 is attached to link lever 79 and extends upwards to accept the interconnecting rod assembly 100 which will be described below in some detail. Spring 104 is now attached between post 78 on stop lever 72 and a spring hole 67 formed in sidewall 65 to bias the end of linear arm 73 against the sidewall such that the radial arm 74 extends outward from the end of the base plate. Hole 85 of angled link 84 fits over post 81 and is secured by cotter pin 87. A vertical tab of angled link 84 has a hole through which connecting rod 117 is passed and secured with nuts 91 and lockwasher 90. Both the left side and right side assemblies 63L, 63R are assembled with the same components such that all moving components in left side assembly 63L are to the left of corresponding stop 69 and all moving components in right side assembly 63R are to the right of corresponding stop 69 and the connecting rod 117 shown in FIG. 5A, for example, is actually the other end of the connecting rod 117 shown in FIG. 5B. This can be seen more clearly in FIGS. 8 and 9.

Figure 6:
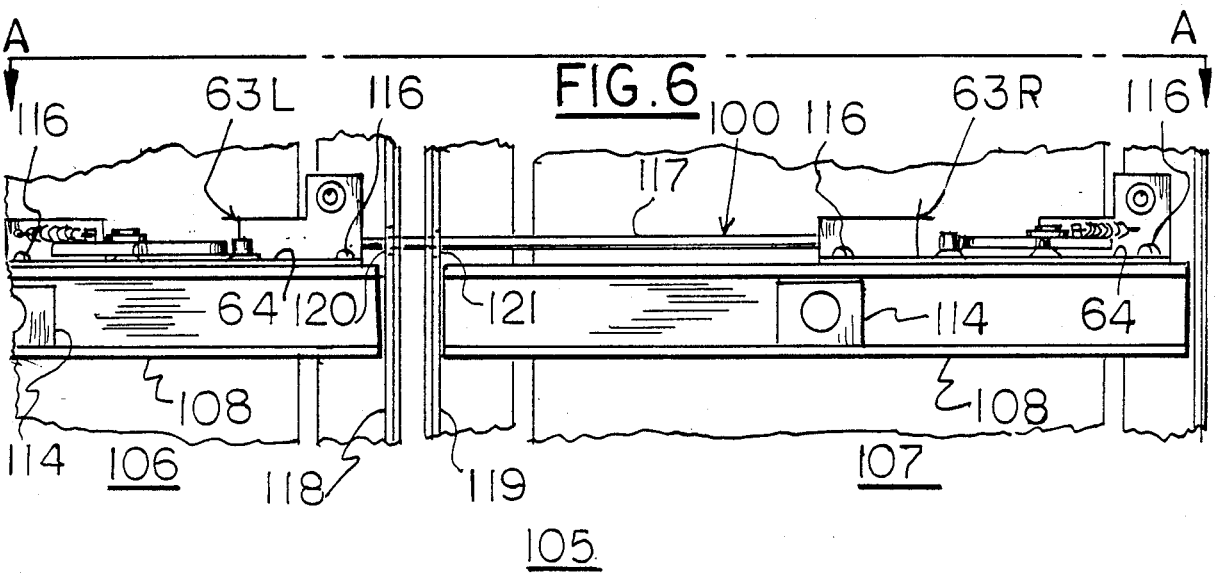
FIG. 6 is a front view of a section of a multiple circuit breaker enclosure containing two separate circuit breaker compartments side by side with the compartment mounted components of the interlock assembly of the invention attached to the respective compartment racking nut channels.
Figure 7:
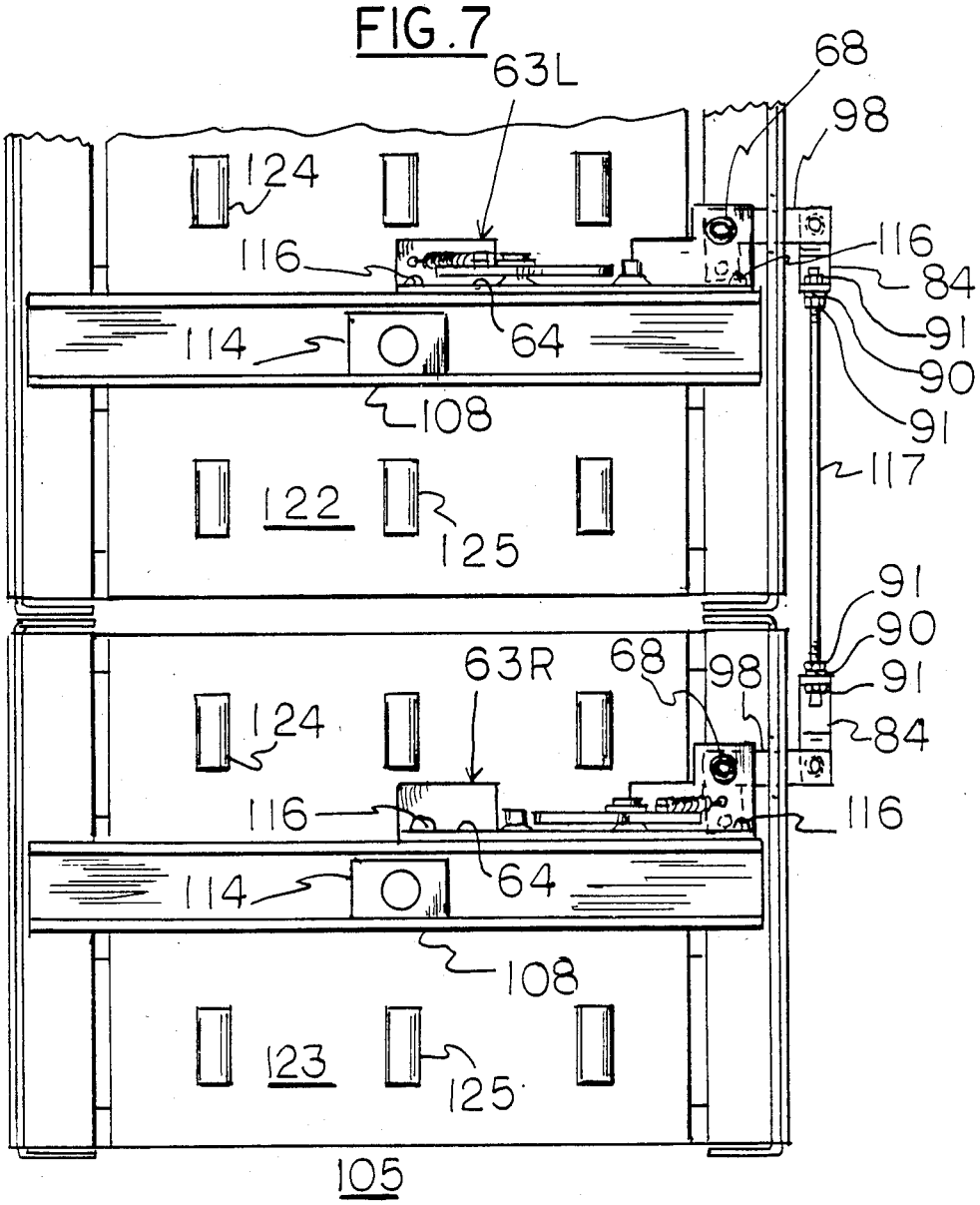
FIG. 7 is a front view of a section of a multiple circuit breaker enclosure containing two separate circuit breaker compartments, one over the other, with the compartment mounted components of the interlock assembly of the invention attached to the respective compartment racking nut channels.

The attachment of the compartment mounted interlock assemblies 63L and 63R within adjoining circuit breaker compartments is best seen by referring now to FIGS. 6 and 7. In FIG. 6, a multiple circuit breaker compartment enclosure 105 is depicted with a left side circuit breaker compartment 106 and a right side compartment 107, side by side. The compartment mounted interlock assembly 63L is installed within left side circuit breaker compartment 106 and compartment mounted interlock assembly 63R is installed within right side circuit breaker compartment 107. Both compartment mounted assemblies 63L, 63R are attached to their respective racking nut channels 108 to the right of the compartment racking nuts 114 by attaching screws 116 through base plates 64. A connecting rod 117 passing through a clearance hole 121 in the right compartment sidewall 119 and through a corresponding clearance hole 120 through the left compartment sidewall 118, interconnects with angled link 84 and link lever 79 as described earlier with reference to FIGS. 5A and 5B. The interaction between left side compartment mounted interlock 63L and right side compartment mounted interlock 63R will be discussed below with reference to FIGS. 8 and 9.

The compartment mounted interlock assemblies 63L, 63R can also be used to interlock two adjoining vertically aligned compartments 122, 123 as shown in FIG. 7 and described as follows. The multiple circuit breaker compartment enclosure 105 contains the top circuit breaker compartment 122 and the bottom circuit breaker compartment 123. Since the top mounted compartment interlock assembly components are similar to the left side components, the reference 63L will be commonly employed. This is also true for the relation between the bottom mounted compartment components, wherein the reference 63R will be commonly employed to refer to the bottom compartment and right side compartment assemblies. A top compartment mounted interlock 63L is connected by means of screws 116 through base plate 64 to the racking nut channel 108 to the right side of racking nut 114 in top compartment 122. The bottom compartment mounted interlock assembly 63R is attached to racking nut channel 108 to the right of racking nut 114 in bottom compartment 123. When a circuit breaker 10 such as depicted in FIG. 1 is inserted within either top or bottom circuit breaker compartment 122, 123, the circuit breaker line and load plugs 13, 14 are aligned for mating with corresponding compartment line and load stabs 124, 125. The racking screw 15 on the rear of circuit breaker 10 is correspondingly aligned with the racking nut 114 on the rear of the circuit breaker compartments as described in the aforementioned patent to Tillson et al. A connecting rod 117 together with angled links 84, nuts 91 and lockwasher 90, described earlier with reference to FIGS. 5A and 5B, are also used to interconnect the vertically adjoining compartment mounted interlock assemblies 63L, 63R. However, bellcranks 98, which are connected at opposite ends to links 79, pivot within their respective journals 68 to transmit the horizontal motion from one interconnect assembly to the other.

Figure 8:
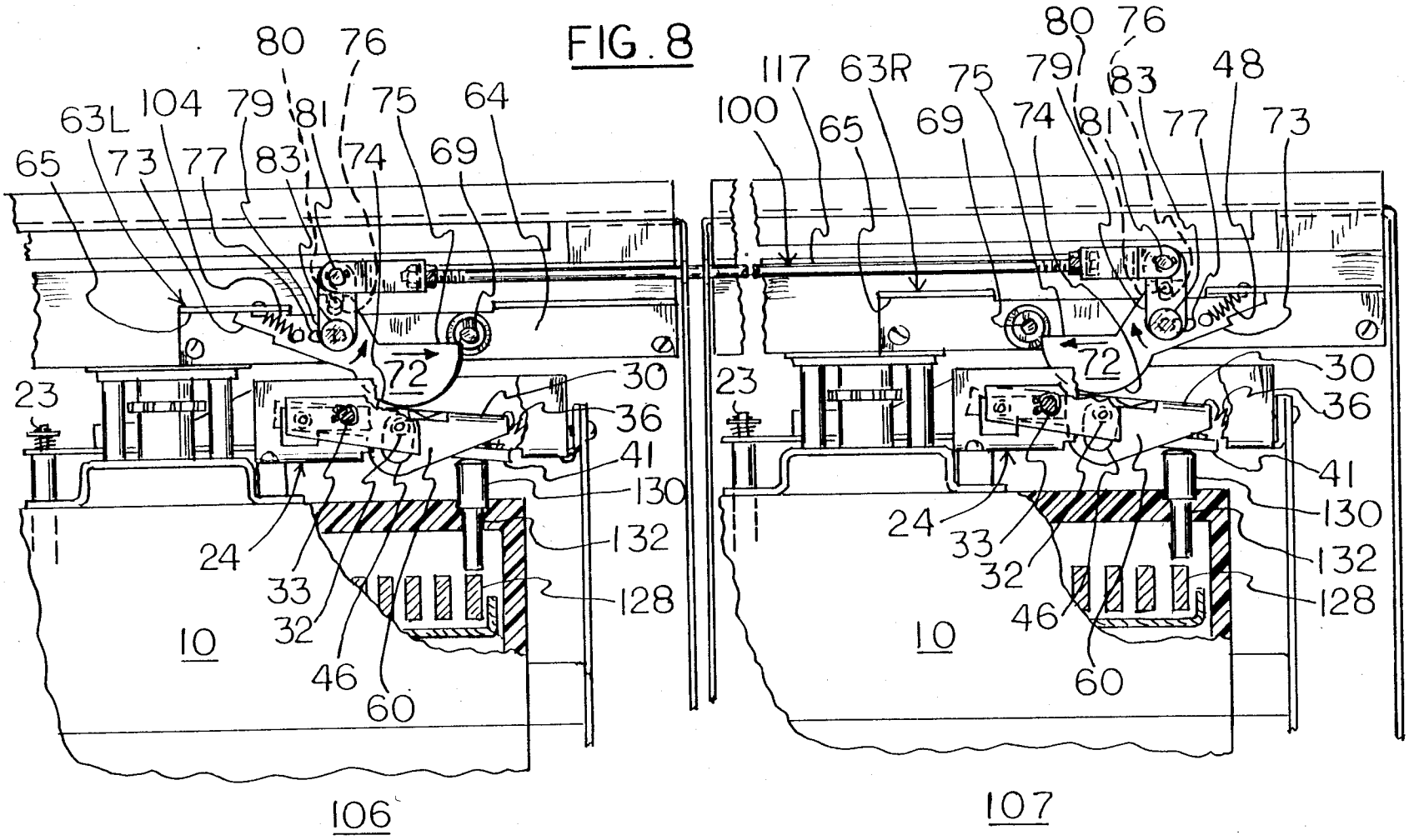
FIG. 8 is a partial top view generally along the line AA indicated in FIG. 6 of two side-by-side circuit breaker compartments with the contacts open in both the left side and right side breakers.
Figure 9:
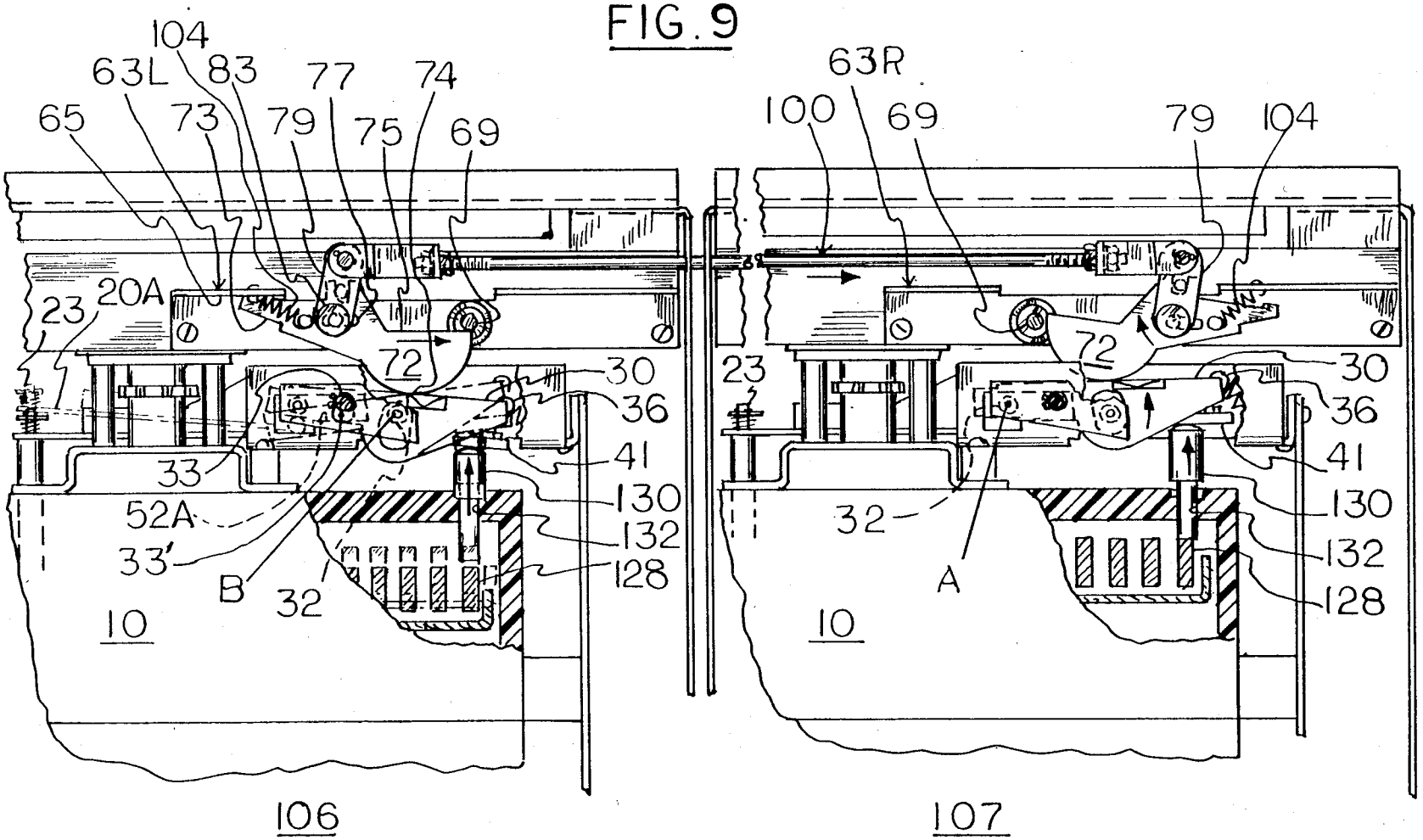
FIG. 9 is a partial top view of the compartments depicted in FIG. 8 with the right side breaker contacts closed causing the compartment mounted components in the left side compartment to be in their locked position while an attempt is made to close the left side compartment breaker.

FIGS. 8 and 9 depict the operation of side-by-side circuit breaker compartments similar to the left side circuit breaker compartment 106 and right side circuit breaker compartment 107 depicted earlier In FIG. 6. Referring to FIG. 8, a circuit breaker 10 is depicted with its contact arms 128 open such that the contact push rod 130 extending through a clearance hole 132 in the back wall of breaker 10 is in an unextended position. The pivot plates 41 on both breaker mounted interlock assemblies 24 are in their non-active, retracted position held by the bias of springs 36 on paddles 30. In this position, link pins 32 abut the forward surfaces of slots 46 within top extensions 60 which in turn keep actuator pins 33 out of contact with their respective extension tabs 34 (FIG. 3). The circuit breaker trip plungers 23 on both breakers are in their non-tripping positions with the breaker contacts open and the breaker mechanism fully charged. A compartment mounted interlock assembly 63L is attached within the left side circuit breaker compartment 106. The radial arms 74 of stop levers 72 abut paddles 30 and linear arms 73, under the bias of springs 104, extend from the sidewalls 65 toward the breakers 10 but out of interference between the stop surfaces 75 and the stops 69 on the base plates 64 for both compartment assemblies 63L, 63R. The stop levers 72 are capable of rotating about pivot pins 83 in the indicated directions as well as moving in the indicated horizontal directions along pivot pins 83 within pivot pin slots 77. The rotational position of both stop levers 72 depends upon the condition of the breaker contact arms 128 and the translational position depends upon movement provided via the connecting rod 117. For both compartment interlock assemblies 63L, 63R, the pivot pins 83 extend through lever links 79 and stop levers 72 which further contain guide slots 76 for capturing guide pins 80. Lever links 79 are provided with posts 81 which in turn are secured to the connecting rod assembly 100 so that rotational motion provided by stop levers 72 is converted into translational motion of the connecting rod 117 and is in turn imparted via the connecting rod to the compartment mounted interlock assemblies 63L, 63R in either adjoining compartment 106, 107. When the stop lever 72 is in the position indicated, with the stop surface 75 away from interference contact with stop 69, the breaker contacts can be closed without causing the breaker to trip. When the breaker contacts in either breaker are closed, the contact push rod 130 becomes extended, moving the pivot plate 41 and paddle 30 in the direction indicated in FIG. 9 for the right compartment 107, for example, forcing the stop lever 72 in a clockwise direction past stop 69 and extending springs 104 and 36. Link 79 also moves in a clockwise direction forcing the connecting rod assembly 100 in the indicated direction rotating link 79 in the left side compartment 106 clockwise about pivot pin 83. Linear arm 73 is prevented from rotating clockwise by abutment with the back wall 65. Stop lever 72 is forced to slide in the indicated direction by means of slot 77. The stop surface 75 is now in interference with stop 69 which effectively prevents the stop lever 72 from rotating in a counterclockwise direction. It is to be noted that the stop lever 72 in this locked position effectively prevents pivot plate 41 and paddle 30 from rotation about one of the link pins 32 at "unlocked" pivot point A.

If an attempt is now made to close the contacts within breaker 10 in the left side compartment 106, the associated contact push rod 130 moves in the indicated direction forcing pivot plate 41, spring 36 and paddle 30 against the radial arm 74 on stop lever 72 as indicated in phantom. This forces paddle 30 to now rotate about the link pin 32 at the "locked" pivot point B.

The associated actuator 33 is now carried by upper and lower links 28, 29 (FIG. 2) into the position shown in phantom at 33' in FIG. 3 where contact is made with extension tab 34. Tab 34, which is part of moveable finger 20, moves finger extension 20A into the tripping position indicated in phantom, pulling the trip plunger 23 outwards to trip the breaker. The slot edges 52A, 50A within slots 52, 50 in extensions 27, 26 (FIG. 4) prevent the contact arms from closing after the breaker is tripped by stopping the forward motion of the actuator pin 33. This in turn arrests any further motion of contact plunger 130 and contact arms 128. This is required since the inertial motion of the contact arms under the closing force of the breaker mechanism could otherwise momentarily close the breaker contacts after tripping, which is undesirable.

It is thus seen that the arrangement of complimentary breaker interlock assemblies consisting of breaker mounted interlock assembly 24 and compartment mounted interlock assemblies 63R, 63L, when interconnected between adjoining breakers in adjoining compartments, prevent the contacts of the breaker in one compartment from being closed when the contacts of the breaker in the adjoining compartment are already closed. This interlock arrangement compliments, but does not interfere with, the breaker interlock arrangement described within the U.S. Patent to Tillson et al, which prevents a breaker within its own compartment from being connected with or disconnected from the compartment power stabs when its own contacts are closed.

We claim:

1. A circuit breaker compartment interlock assembly comprising:

first circuit breaker interlock means mounted on a first circuit breaker within a first circuit breaker compartment and associated with a first contact push rod extending from said first breaker to sense whether first contacts within said first breaker are open or closed and with a first breaker trip rod; and first compartment interlock means mounted in said first compartment and connected with said first breaker interlock means and with a second compartment interlock means mounted in a second circuit breaker compartment containing a second circuit breaker having second breaker contacts for causing said first breaker interlock means to actuate said first trip rod to trip said first breaker when an attempt is made to close said first breaker while said second breaker is already closed.

2. The interlock assembly of claim 1 including:

second circuit breaker interlock means mounted on said second breaker and associated with a second contact push rod extending from said second breaker to sense whether said second contacts within said second breaker are open or closed and with a second breaker trip rod for actuating said second trip rod to trip said second breaker when an attempt is made to close said second breaker while said first breaker is already closed.

3. The interlock assembly of claim 1 wherein said first breaker interlock means comprises:

a breaker interlock base;

a paddle pivotally mounted on said breaker interlock base; and a pivot lever mounted on said breaker interlock base for contacting said paddle and said first push rod to move said paddle into contact with said first compartment interlock means.

4. The interlock assembly of claim 1 wherein said first compartment interlock means comprises:

a compartment interlock base;

a stop lever pivotally and slideably mounted on said compartment interlock base; and a stop on said compartment interlock base for preventing rotation of said stop lever when said stop lever moves in a first direction.

5. The interlock assembly of claim 3 wherein said first breaker interlock means further includes:

a breaker interlock spring for biasing said paddle against said first contact push rod; and an actuator pin extending through a slot in said paddle and a slot in said breaker interlock base for contacting first trip means connected to said first trip rod to trip said first breaker.

6. The interlock assembly of claim 5 wherein said first breaker interlock means further includes:

a first link pin extending through top and bottom slots in said paddle for guiding said paddle during rotation about a first pivot.

7. The interlock assembly of claim 6 wherein said first breaker interlock means includes:

a top plate interconnected with said breaker interlock base by means of a backplate; and a second link pin extending through a top slot in said top plate and a bottom slot through said breaker interlock base and providing said first pivot for said paddle until said first link pin bottoms against said paddle slot whereby said paddle then pivots about said first link pin to move said actuator pin into contact with said first trip means.

8. The interlock assembly of claim 7 including adjusting means on said pivot lever for reducing clearance between said pivot lever, said paddle and said first push rod.

9. The interlock assembly of claim 4 wherein said first compartment interlock means further includes:

means defining a first slot through said stop lever in a plane coextensive with said compartment interlock base for guiding motion of said stop lever in said first direction;

a link lever connecting with said stop lever by means of a pivot pin at one end within said first stop lever slot and by means of a fixed pin at an opposite end within a second slot through said stop lever.

10. The interlock assembly of claim 9 wherein said first compartment interlock means further includes:

an end plate extending from said compartment interlock base and containing means defining an end plate slot for clearance of said stop lever and said link lever;

a radial arm on said stop lever for contacting with said paddle and rotating said stop lever in response to rotation of said paddle when said radial arm is free from interference with said stop and for preventing said paddle and said stop lever from rotating when said radial arm is in interference contact against said stop.

11. The interlock assembly of claim 10 wherein said first compartment interlock includes:

a compartment interlock spring extending from said stop lever and said end plate for biasing said radial arm away from said stop and for biasing said pivot pin against one edge of said first stop lever slot.

12. The interlock assembly of claim 11 wherein said first compartment interlock means includes:

connection means between said link lever and said second compartment interlock means for moving said pivot pin against an opposite edge of said first stop lever slot to place said stop lever radial arm in interference contact with said stop.

13. The interlock assembly of claim 5 wherein said slot includes a slot edge for stopping further motion of said actuator pin thereby preventing further travel of said first push rod and said first contacts after said first breaker is tripped.

14. The interlock assembly of claim 12 wherein said connection means includes a pair of bellcranks for vertically interconnecting said first and second circuit breaker compartments.

* * * * *